United States Patent [19]

Dahlgren et al.

[11] 4,452,139

[45] Jun. 5, 1984

[54] DAMPENING FLUID EVAPORATOR AND METHOD

[76] Inventors: Harold P. Dahlgren, 11 Turtle Creek Bend, Dallas, Tex. 75204; James E. Taylor, 4129 Drowsy La., Dallas, Tex. 75233; Dwight W. Peters, Rte. 1, Box 50N, Grapevine, Tex. 76051

[21] Appl. No.: 371,807

[22] Filed: Apr. 26, 1982

Related U.S. Application Data

[63] Continuation-in-part of PCT/US81/01213, Sep. 8, 1981, published as WO 83/00842, Mar. 17, 1983, abandoned.

[51] Int. Cl.[3] ..... B41F 7/26; B41F 31/04

[52] U.S. Cl. ..... 101/148; 101/350; 101/450.1

[58] Field of Search ..... 101/148, 349, 350, 351, 101/352, 363, 365, 207, 208, 210, 450.1; 118/261, 262, 413

[56] References Cited

U.S. PATENT DOCUMENTS

| | | | |
|---|---|---|---|
| 1,730,302 | 10/1929 | Smith | 101/425 |
| 3,559,572 | 2/1971 | Hackley | 101/350 |
| 4,088,074 | 5/1978 | Dahlgren et al. | 101/148 |
| 4,127,067 | 11/1978 | Dahlgren | 101/350 X |
| 4,211,167 | 7/1980 | Corse | 101/148 |

FOREIGN PATENT DOCUMENTS

| | | | |
|---|---|---|---|
| 2812998 | 11/1978 | Fed. Rep. of Germany | 101/363 |

*Primary Examiner*—J. Reed Fisher

*Attorney, Agent, or Firm*—Gerald G. Crutsinger; John F. Booth; Monty L. Ross

[57] ABSTRACT

A method and apparatus to ink and dampen a lithographic printing plate wherein one or more of four disclosed embodiments of a dampening fluid evaporator device directs a continuous stream of air or other drying fluid along the length of a single resilient inking form roller (22) to remove dampening fluid from the roller (22) while leaving substantially dry ink on the roller surface.

13 Claims, 7 Drawing Figures

DAMPENING FLUID EVAPORATOR AND METHOD

CROSS REFERENCE TO RELATED APPLICATION

This is a continuation-in-part of our copending International Application Ser. No. PCT/US81/01213 filed Sept. 8, 1981 entitled "Dampening Fluid Removal Device," the disclosure of which is incorporated herein by reference in its entirety for all purposes.

Printing plates for lithographic printing presses require application of dampening fluid to render hydrophilic non-image areas ink rejecting so that ink will adhere only to image areas which are oleophilic. Dampeners of the type disclosed in Dahlgren U.S. Pat. No. 3,168,037 apply a film of dampening fluid to a film of ink on a ink coated base roller which in turn carries a composite film of ink and dampening fluid to the lithographic printing plate.

Dahlgren et al. U.S. Pat. No. 4,088,074 discloses an inker comprising a single resilient form roller applying both ink and dampening fluid to a lithographic printing plate. In order to combat accumulation of excess dampening fluid in the reservoir, an air bar having spaced openings was employed for evaporating excess dampening fluid from the surface of the single form roller.

Corse U.S. Pat. No. 4,211,167 discloses an inker comprising a single resilient covered form roller to which both ink and dampening fluid are applied. A small rod is positioned parallel to the single form roller and is pressed against the soft surface layer of the form roller to form a barrier against dampening fluid, while allowing all of the residual ink on the form roller to pass the rod and remain on the surface of the form roller.

The dampening fluid evaporation device disclosed herein relates to improvements in dampening fluid evaporation and removal devices of the type disclosed in the aforementioned Dahlgren and Corse patents and in our copending international patent application.

A primary object of the invention is to provide a dampening fluid evaporation device which is capable of removing dampening fluid from ink to eliminate or reduce emulsification resulting in water related problems in lithographic printing techniques.

Another object is to provide a dampening fluid evaporation device to prevent diminishment of color intensity caused by accumulation of dampening fluid.

It is still another object to provide a dampening fluid evaporation device to prevent stripping of a critical inking roller in an abbreviated ink train resulting from uncontrolled accumulation of dampening fluid in an ink fountain.

A further object of the invention is to provide a dampening fluid evaporation device on a single form roller to maintain a substantially anhydrous supply of ink, a thin film of which is incapable of absorbing an excessive amount of dampening fluid from a single dampening fluid transfer roller.

Other and further objects of the invention will become apparent upon reference to the following detailed description of four embodiments of our invention.

SUMMARY OF INVENTION

The improved dampening fluid evaporation and removal device disclosed herein is employed in a printing press wherein ink and dampening fluid are applied to a lithographic plate; wherein dampening fluid having a viscosity of approximately one centipoise is applied to the printing plate to render hydrophilic, non-image, areas on the printing plate ink rejecting; and wherein ink, having a viscosity significantly greater than the dampening fluid, is applied by an inking roller to oleophilic image areas on the printing plate. In addition, the vapor pressure of the dampening fluid is higher than that of the ink. Typically a water alcohol mixture is used for the dampening fluid.

A dampening fluid removal device is provided having a doctor blade positioned in pressure indented relation with an inking roller to engage ink and dampening fluid on the portion of the surface of the roller which has applied ink to the printing plate and before fresh ink is applied. The metering portion of the doctor blade is extremely thin and flexible and is positioned at an angle relative to a line tangent to the roller surface to remove fluid having a viscosity less than a predetermined viscosity from the surface of the inker roller and to leave fluid having a viscosity greater than the predetermined viscosity on the surface of the roller.

The dampening fluid evaporation device of the present invention can comprise one or more of the following embodiments which are fixed in operative association with the inking roller.

In a first embodiment, a dampening fluid evaporation device comprises an enclosure coupled to a source of pressurized drying fluid. The enclosure is open on one side and in fluid communication with the liquid on the surface of the inking roller to evaporate dampening fluid on the portion of the surface of the roller which has applied ink to the printing plate and before fresh ink is applied. One embodiment of this enclosure of the evaporation device is positioned in close proximity to the inking roller and overlaps an arc of the outside surface of the inking roller. Air injected into the enclosure is discharged from the enclosure through a nozzle defined by the annular space formed between the enclosure and the surface of the inking roller. A baffle or deflector plate is provided in the enclosure to diffuse the air flow therein and to cause the air to be discharged along the length of the roller surface in a circumferential direction either opposite to or the same as the direction of rotation of the inking roller.

In a second embodiment, the enclosure is formed by two idler rollers in contact with the surface of the roller. Air is injected by a nozzle into the enclosure formed between the two rollers and is discharged axially from the space defined therebetween.

In a third embodiment, spaced nozzles are positioned adjacent a doctor blade to form a continuous, substantially uniform air stream which impinges against the roller surface.

In a fourth embodiment, an enclosure is formed utilizing a pair of axially extending walls supported from the mounting frame. A narrow slot is formed between the walls adjacent the surface of the form roller to direct a stream of air in a direction opposite to the direction of travel of the form roller surface.

With devices of this type, ink conditioning and smoothing rollers can be provided to contact a fresh virtually water-free (dry) metered film of ink to form a matte, dampening fluid receptive finish on the surface of the fresh ink before dampening fluid is applied to the film of ink. A dampener is positioned adjacent to the conditioning rollers and provides dampening fluid to the surface of the ink film. The fresh, dry (i.e., free of dampening fluid) film of ink and dampening fluid are combined and then carried by the lithographic printing plate where both ink and dampening fluid are applied to a printing plate. Excess dampening fluid remaining attached to the ink on the form roller after contacting the plate is removed by the ink removal device and/or evaporation device.

The inks used are conventional lithographic printing inks but are advantageously formulated to have lower water pick-up than inks normally used in conventional inking trains having a plurality of form rollers.

Adjustments are provided for adjusting the indentation of the doctor blade into the resilient roller surface and for adjusting the angle of the metering surface on the doctor blade relative to a line tangent to the roller for changing the efficiency of the doctor blade and causing a fluid of a low viscosity to be selectively removed from the fluid of a higher viscosity carried by the resilient surface of the form roller. Adjustments to control the flow of air or other drying fluid to the evaporator are provided to control the amount of removal of fluid from the inker roller.

DESCRIPTION OF DRAWING

Drawings of four embodiments of the invention are annexed hereto, in which.

Numeral references are employed to designate like parts throughout the various figures of the drawings.

DESCRIPTION OF THE PREFERRED EMBODIMENT

Figure 1:
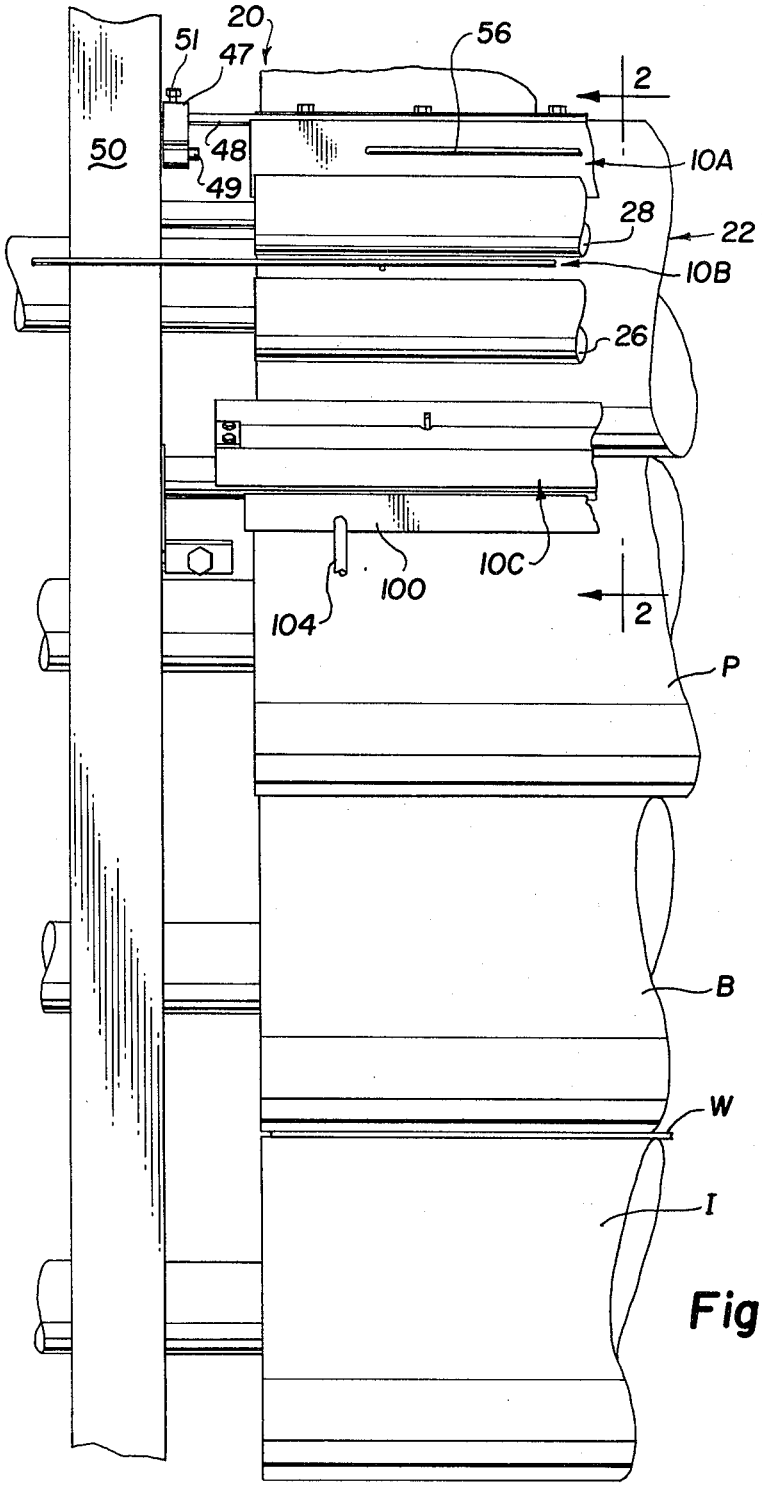
FIG. 1 is a fragmentary front elevational view of a lithographic printing press having the dampening fluid evaporator of the present invention mounted thereon.

Referring to the drawings, the numerals 10A, 10B, 10C and 10D are utilized to generally designate the dampening fluid evaporation device of the present invention. The dampening fluid evaporation device is mounted on an offset lithographic printing press having a conventional plate cylinder P, blanket cylinder B and impression cylinder I mounted thereon for printing on a sheet or web of paper W.

The printing press is equipped with inker 20 comprising a single inking form roller 22 having a resilient outer cover to provide a resilient outer surface 24 which is engaged by ink metering means 23. Inker 20 can be of the design in our international application referred to herein above and incorporated herein by reference.

In this device, a pair of vibrator rollers 26 and 28 are positioned between the plate cylinder P and ink metering means 23. Vibrator rollers 26 and 28 vibrate or oscillate to form a matte finish on the surface of any liquid left on the periphery of the inking form roller 22 to render the film more receptive to fresh ink applied by the ink metering means 23. Further, rollers 26 and 28 redistribute the ink remaining on the form roller.

A pair of material conditioning rollers 30 and 32 are urged into pressure indented relationship with a film of fresh, dry ink formed on form roller 22 by ink metering means 23. Rollers 30 and 32 form a smooth matte finish on the freshly metered dry film of ink to make the film of fresh ink more receptive to dampening fluid.

The dampener 34 is of the type disclosed and described in Dahlgren U.S. Pat. No. 3,343,484, the disclosure of such is incorporated herein by reference, and includes a hydrophilic transfer roller 36 and a resilient covered metering roller 38 urged into pressure indented relation. Transfer roller 36 and form roller 22 may be driven at different speeds as is well known in the art.

The resilient surfaced ink form roller 22 comprises a hollow, rigid, tubular metallic core 40 having a resilient non-absorbant cover 24 secured thereto, the cover having a uniformly smooth, uniformly textured and resilient outer surface 42. The cover 24 on applicator roller 22, while being resilient, is relatively firm, for example, in a range of 40 to 80 Shore A durometer. The cover 24 on resilient surfaced ink form roller 22 is preferably formed of a resilient urethane, polyurethane, rubber or rubber-like material attached to a metallic core 40.

The dampening fluid evaporator device may consist of a first evaporator 10A, a second evaporator 10B, and a third evaporator 10C. These devices 10A, 10B, and 10C are positioned on the inker form roller 22 to evaporate dampening fluid from the surface of the roller. Many combinations of these evaporators are useful.

Figure 2:
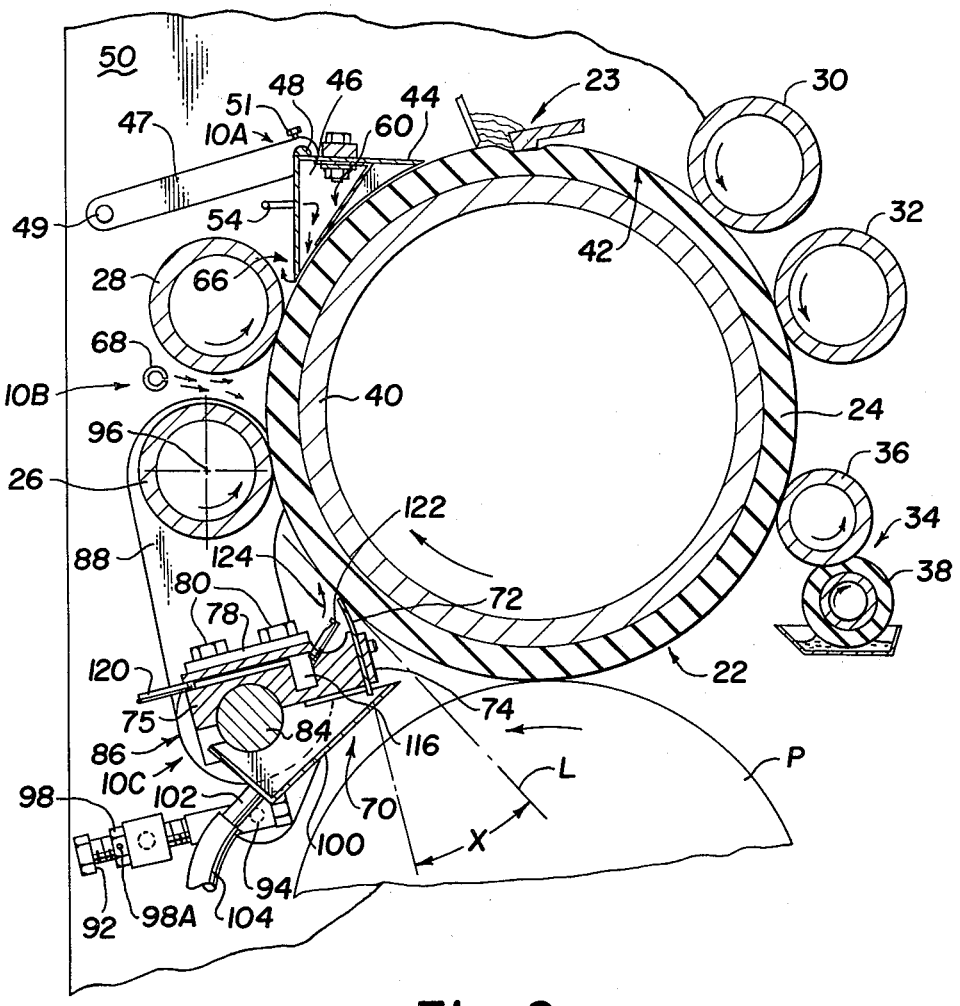
FIG. 2 is a cross sectional view taken along line 2—2 of FIG.1.
Figure 3:
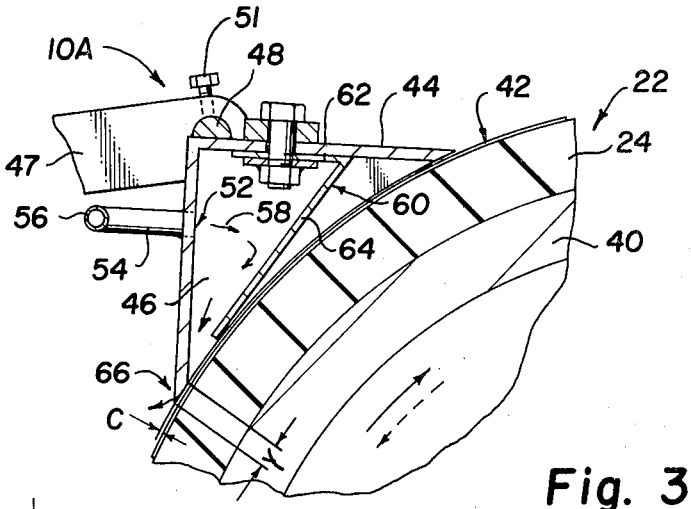
FIG. 3 is an enlarged sectional view of a portion of FIG. 2, illustrating a first embodiment of the dampening fluid evaporator.
Figure 3A:
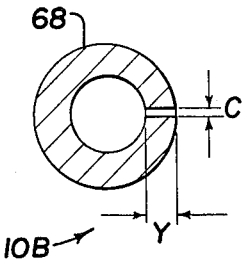
FIG. 3*a* is an enlarged cross sectional view of a second embodiment of a dampening fluid evaporator.

As best illustraed in FIGS. 2 and 3, the device 10A is positioned on the inking roller between the inking metering member 23 and the vibrator roller 28. In other combinations, device 10A may be advantageously positioned between the plate cylinder and vibrator roller 26. The evaporation device 10A has an inverted "V" shaped housing 44 with its open side facing inking roller 22. Devices 10 are provided to evaporate dampening fluid from the surface of roller 22. The housing 44 is mounted adjacent roller 22 and is closed on its ends to form closure or chamber 46 under the housing 44. Housing 44 can be formed from angle stock with plates fastened across the ends thereof. The housing 44 could of course assume shapes other than an inverted "V", it only being important that the enclosure be formed to properly direct the flow of drying gas in a continuous stream along the length of roller 22.

The housing 44 is supported from a pair of parallel extending crankarms 47 attached at opposite ends. Housing 44 is connected to crankarm 47 by a pair of shafts 48 which are journaled to rotate on an axis parallel to the axis of rotation of the roller 22. A set screw 51 is provided in each of the crankarms 47 to lock the shaft 48 against rotation when the housing is in the appropriate orientation. The crankarms 47 are in turn connected to a pair of coaxial spaced shafts 49 and journaled from the frame 50. Shafts 49 rotate to move the crankarm 47 and housing 44 toward and away from the surface of roller 22. Means not shown, such as set screws, are provided to maintain shaft 49 fixed in the position to, in turn, position housing 44 in a desired relationship with the surface of roller 22.

Figure 4:
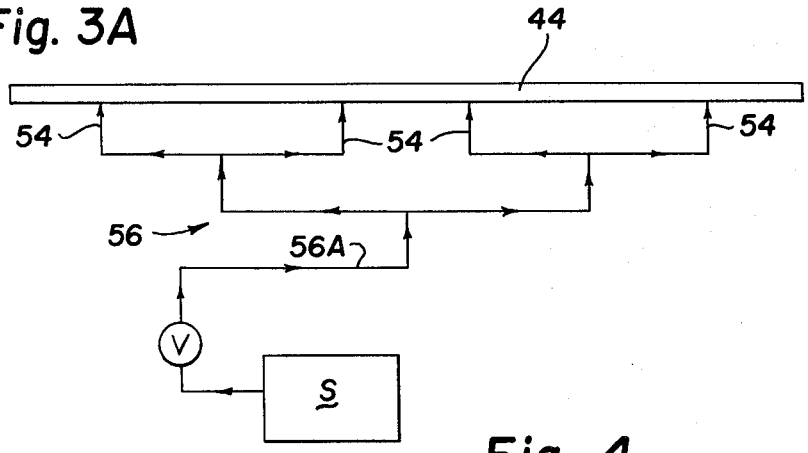
FIG. 4 is a conduit diagram for the apparatus of FIG. 3.

The housing 44 is positioned, as shown in FIG. 3, radially spaced from the surface of the roller by clearance C. This clearance can be in the range of 0.010 to 0.030 of an inch. Housing 44 is provided with a plurality of laterally spaced ports 52 communicating with the enclosure 46. A plurality of short conduits 54 are coupled between the ports 52 and a supply manifold 56. The supply manifold is shown in detail in FIG. 4 and comprises a source of drying fluid such as pressurized dry warm air. Suitable valving is in turn connected to a conduit 56A. Conduit 56A is divided by three T-fittings as shown and the resulting divisions are connected to conduits 54 to supply air to the housing 44. It is advantageous to have valving V coupled with dampener 34 such that when dampener 34 is "on" or operating valving V is open and when dampener 34 is "off" valving V is closed.

When valving V is open, drying fluid will flow into the enclosure 46 in the direction of arrow 58. A baffle or deflector plate 60 is positioned in the enclosure 46. Plate 60 extends longitudinally across the width of the enclosure 46. Plate 60 is angle-shaped as shown with one leg 62 fixed to housing 44. The other leg 64 extends to a point adjacent to but without contacting roller 22. Deflector plate 60 is positioned in the path of drying fluid entering enclosure 46. Plate 60 acts to diffuse the flow and causes the flow to be diverted to flow in the direction opposite to the direction of rotation of inker roller 22 and in a direction away from the ink metering member 23. If this evaporator is installed in the lower position between plate cylinder P and vibrator 26, the air flow should be in a direction away from plate cylinder P. The flow path of drying fluid descends parallel to the surface of the roller 22 and escapes from the enclosure 46 at point 66 formed by the clearance C between the housing 44 and roller 22. The leg of housing 44 is cut and machined so as to form a long aperture nozzle with the surface 42 of roller 22 at a clearance C for a distance Y where Y is greater than four times C. This flow path causes a gas-liquid contact between the liquid dampening fluid and the drying fluid and further causes a "knife" of gas to impinge on the adjacent vibrator roller 28. For example, if the drying fluid is dry warm air and the dampening fluid is alcohol and water, evaporation of the excess alcohol and water from the surface of inker roller 22 will occur. In addition, by diffusing the flow of the drying gas, a more uniform evaporation occurs across the width of the roller 22. The small clearance C for the distance Y, in addition, forms a nozzle which causes a low pressure adjacent to the surface of the roller 22 which enhances the evaporation of the liquid and the "knife" as the gas exits the nozzle. Due to the fact that the ink and the dampening liquid have different vapor pressures, this flow of drying air will selectively remove the dampening fluid by evaporation from the surface of the roller 22. It will allow the return of dry ink to the ink metering device 23.

In addition to the ink evaporation device 10A, a second ink evaporation device 10B is provided adjacent the surface of roller 22 and is positioned between the ink metering member 23 and the plate roller P. This ink evaporation device 10B simply consists of a combination of the two vibrator rollers 26 and 28 and a nozzle (air knife) 68 positioned to inject dry air into the space formed between the two rollers as shown in FIG. 2. The nozzle 68 comprises a conduit extending along the length of the rollers 26 and 28. This conduit is connected to a supply of and control mechanism for dry air. The conduit has an elongated slit which provides a thin flat stream of air directed against the exterior surface of the roller 22 to impinge on and evaporate dampening fluid therefrom. The nozzle 68 defined by the slit of the conduit has a width C and a length Y where Y is more than four times C. The ends of the space formed between rollers 26 and 28 are left open so that the drying air injected by nozzle 68 can be discharged in an axial direction from the space defined between the two rollers.

Figure 5:
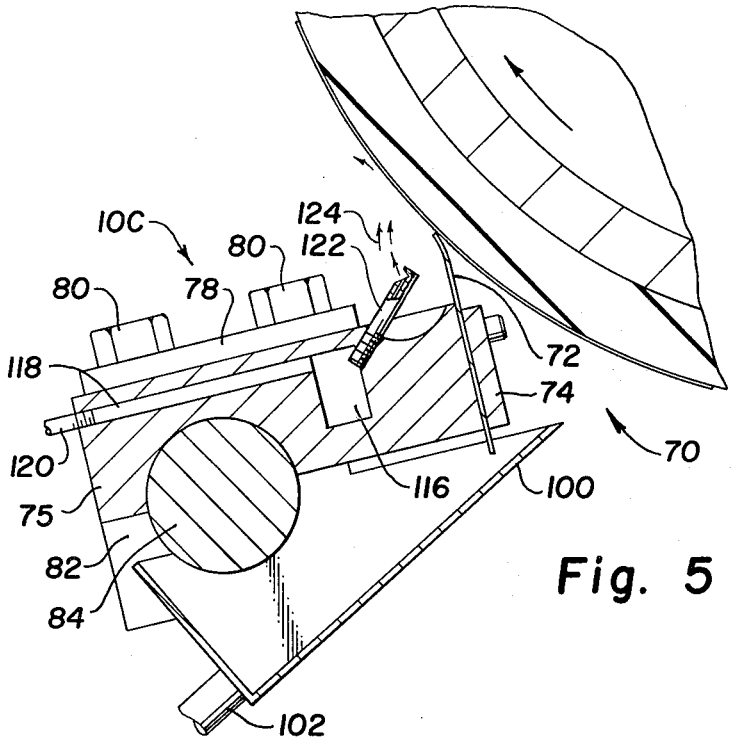
FIG. 5 is an enlarged sectional view of a portion of FIG. 2, illustrating a third embodiment.

In addition to the evaporator devices 10A and 10B, a third evaporative device 10C, best illustrated in FIGS. 2 and 5, may be provided in combination with a dampening fluid removal device 70. The device 70 comprises a doctor blade 72, which may comprise, for example, a flat strip of metallic material, such as stainless steel having a thickness of about 0.010 of an inch. Blade 72 is sufficiently flexible to be deformed when urged into light pressure indented relation with a resilient cover of form roller 22 to maintain substantially uniform pressure along the length of form roller 22 and along the edge of doctor blade 72. Doctor blade 72 in the illustrated embodiment is disposed at an angle X of about 30 degrees or less to the tangent line L. Doctor blade 72 is secured by a clamp bar 74 to mounting bar 75 having opposite ends rotatably secured between hangers 88 which are rotatably secured about hangers (not shown) for mounting opposite ends of vibrator roller 26.

In the particular embodiment of the invention illustrated in FIG. 5, opposite ends of mounting bar 75 are secured by connector plates 78 and screws 80 to journal blocks 82 having a journal 84 extending outwardly therefrom. Journals 84 are mounted in bearings 86 in hanger 88.

Bearings 86 comprise split bearing blocks including semicircular bearing segments secured together by screws.

Thus, when bearing segments are loosened, journals 84 and doctor blade 72 can be rotated in bearing block segments for adjusting the angular relationship between doctor blade 72 and a line L tangent to form roller 22.

Each hanger 88 is equipped with an externally threaded adjustment screw 92 for adjusting indentation of the doctor blade 72 into the resilient surface of the form roller 22. Externally threaded screw 92 extends through an internally threaded anchor nut pivotally secured to the press side frame and the end of each adjustment screw 92 is rotatably secured in an anchor member 94 pivotally secured to the lower end of hanger 88. Thus, rotation of adjustment screw 92 causes hanger 88 and doctor blade 72 to rotate about the axis 96 parallel to the axis of vibrator roller 90.

When the desired indentation of doctor blade 72 into the resilient cover of the form roller 22 is obtained, a lock nut 98 is moved into engagement with the anchor nut and secured in position by a set screw 98A to assure that the edge of doctor blade 72 will be repositioned in the same indented position with the surface of the resilient form roller after doctor blade 72 has been moved out of indentation with the resilient roller surface for cleaning.

As will be hereinafter more fully explained, the pressure and angular relationship of doctor blade 72 relative to the surface of form roller 22 is maintained to prevent passage of low viscosity dampening fluid or an emulsion of ink and dampening fluid while leaving higher viscosity ink on the surface of form roller 22.

Dampening fluid removed from the surface of form roller 22 by doctor blade 72 flows by gravity downwardly into a dampening fluid collection tray 100 having downwardly inclined bottom walls. A drain pipe 102 communicates with the inside of tray 100 and dampening fluid collected therein is discharged through a hose 104 to waste or filtered and reused.

The evaporation device 10C also utilizes the doctor blade 72 as a wall to form a barrier to block the flow of air toward the printing plate. Clamp bar 74 has an elongated chamber 116 formed therein which communicates through supply port 118 to a conduit 120. Conduit 120 can be coupled to a suitable valving and source means to provide pressurized dry air to the chamber 116.

A plurality of nozzles 122 communicate with the chamber 116 for supplying dry fluid to the surface of roller 22. Nozzles 122 are designed to direct a plurality of overlapping fan shaped streams of air to create a continuous flow of air from the nozzles in the direction of arrows 124 toward the roller surface.

In operation, the fluid evaporation device 10C causes pressurized dry air to flow from conduit 120 through port 118 and into chamber 116. Chamber 116 in turn supplies pressurized gas through nozzles 122.

Figure 6:
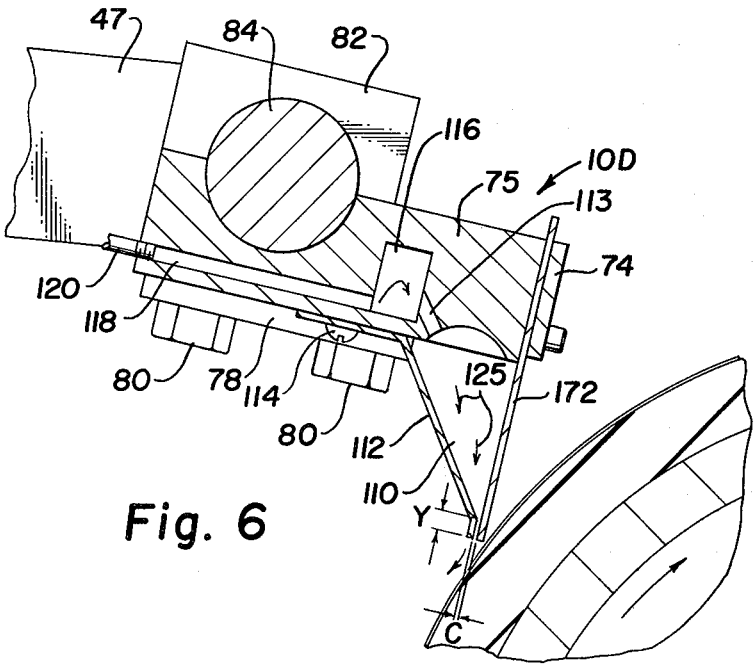
FIG. 6 is an enlarged sectional view of a fourth embodiment.

The fourth embodiment 10D of the evaporation device illustrated in FIG. 6 is similar to the third embodiment hereinbefore described and may be substituted for one or both of the devices 10A and 10B.

In the particular embodiment of the invention illustrated in FIG. 6, opposite ends of mounting bar 75 are secured by connector plates 78 and screws 80 to journal blocks 82 having a journal 84 extending outwardly therefrom. Journals 84 are rotatably secured mounted to crankarms 47 and may be locked in position.

The evaporation device 10D utilizes a second wall 172 in lieu of the doctor blade 72 as a wall to form a chamber or enclosure 110. The enclosure 110 is formed by the wall 172, the mounting bar 75 and a rear wall 112. Rear wall 112 can be formed of a metallic material and is formed as illustrated and bolted to the upper surface of the mounting bar 75 by fasteners 114. Rear wall 112 likewise extends adjacent, but not in contact with, the exterior surface of roller 22 and provides a clearance C of for example 0.030 inch as shown in FIG. 6 between walls 112 and 172. A long narrow slot nozzle is formed by the convergence of walls 112 and 172; this nozzle has a width C and a length Y where Y is at least four times C.

Mounting bar 75 has an elongated chamber 116 formed therein. Chamber 116 in turn communicates through supply ports 118 to a conduit 120. Conduit 120 can be coupled to a suitable valving and source means to provide pressurized dry heated air to the chamber 116.

A plurality of passages 113 communicate with the chamber 116 for supplying pressurized dry heated fluid to the enclosure 110. Passages 113 are designed to direct a flow of air in the direction of arrows 125 toward clearnace C. End walls (not shown) are provided for the enclosure 110 to prevent air from flowing out the ends of the chamber.

As can be appreciated, fluid removal device 70 cooperates with the fluid evaporation devices 10A, 10B, 10C, and 10D to provide a return of dry ink to the ink metering member 23. This enhances the operation of lithographic printing techniques.

The method of utilizing the apparatus of the present invention in a lithographic printing device of FIGS. 1 and 2 is as follows:

First, ink is metered onto the exterior of a inker form roller 22 by ink metering member 23. The volume of ink being applied to the inker form roller 22 is adjusted to provide an adequate and uniform coat of ink onto the roller. Next, the ink is smoothed and conditioned by idler rollers 30 and 32 to form a dampening fluid receptive outer surface on the ink. The dampener 34 may provide an excess of dampening fluid to the ink film on form roller 22, provide that the dampening fluid removal device 72 and evaporation devices 10A, 10B, 10C or 10D remove substantially all of the dampening fluid from the film of ink carried by the form roller 22 from the printing plate to the ink metering member 23. We have observed that if the ink film which receives dampening fluid from dampening fluid transfer roller 36 is relatively dry, only a limited amount of dampening fluid will be applied. The dampening fluid rejected by the ink film is returned by the dampening fluid transfer roller 36 to the nip between rollers 36 and 38 of the dampener.

This mixture of printing ink and dampening fluid then contacts a printing plate P which selectively removes dampening fluid and ink from the roller 22 in the desired image area. Next, the ink and dampening fluid mixture remaining on the form roller 22 has the excess dampening fluid removed from the ink by the dampening fluid removing apparatus of the present invention to return a supply of dry ink to the ink metering member 23. The dampening fluid removal apparatus of the present invention first separates the dampening fluid from the ink by selectively removing all liquids from the exterior of a roller which have viscosities less than the printing ink and secondly by evaporating all liquids from the form roller which evaporate more readily than the printing ink. This evaporation process may be done before, during and after agitation of the ink and dampening fluid mixture on the exterior of the form roller to improve the efficiency of the evaporation device.

Thus, the present invention discloses an apparatus for evaporating dampening fluid and a method for printing which allows the use of an excess of dampening fluid and the later removal of the dampening fluid from the form roller prior to applying ink to the form roller.

Having described our invention, we claim:

1. A method of inking a lithographic printing plate wherein dampening fluid having a viscosity of approximately one centipoise, is applied to the printing plate to render hydrophilic, non-image areas, on the printing plate ink rejecting; and wherein ink, having a viscosity significantly greater than 10 poise, is applied by a single inking form roller, having a resilient surface, to oleophilic, image, areas on the printing plate at an inking nip, the improvement comprising the steps of: positioning a doctor blade in pressure indented relation with the resilient surface of the inking roller to engage ink and dampening fluid on the portion of the surface of the inking roller which has applied ink to the printing plate and before fresh ink is applied to the portion of the inking roller surface; positioning the metering surface of the doctor blade at an angle relative to a line tangent to the roller surface to remove liquid having a viscosity less than a predetermined viscosity from the surface of the inking roller and to leave liquid having a viscosity greater than the predetermined viscosity on the surface of the inking roller; directing a stream of drying fluid to engage the surface of the from roller to evaporate dampening fluid which passes the doctor blade; rotating a roller in pressure indented relation with the single inking form roller to form a matte surface on the film of liquid on the form roller from which liquid has been removed by the doctor blade; and applying fresh ink having a viscosity greater than said predetermined viscosity to the portion of the inking form roller surface from which liquid having a viscosity less than said predetermined viscosity has been removed.

2. A method of inking a lithographic printing plate wherein dampening fluid having a viscosity of approximately one centipoise, is applied to the printing plate to render hydrophilic, non-image areas, on the printing plate ink rejecting; and wherein ink, havinq a viscosity significantly greater than 10 poise, is applied by a single inking form roller, having a resilient surface, to oleophilic, image, areas on the printing plate at an inking nip, the improvement comprising the steps of: positioning a doctor blade in pressure indented relation with the resilient surface of the inking form roller to engage ink and dampening fluid on the portion of the surface of the inking form roller which has applied ink to the printing plate and before fresh ink is applied to the portion of the inking form roller surface; positioning the metering surface of the doctor blade at an angle relative to a line tangent to the roller surface to remove liquid havinq a viscosity less than a predetermined viscosity from the surface of the inking form roller and to leave liquid having a viscosity greater than the predetermined viscosity on the surface of the inking form roller; directing a stream of drying fluid to engage the surface of the form roller to evaporate dampening fluid which passes the doctor blade; rotating a roller in pressure indented relation with the single inking form roller to form a matte surface on the film of liquid on the inking form roller from which liquid has been removed by the doctor blade; directing a second stream of drying fluid to said inking form roller to evaporate dampening fluid remaining in the film of liquid; and applying fresh ink having a viscosity greater than said predetermined viscosity to the portion of the inking form roller surface from which liquid having a viscosity less than said predetermined viscosity has been removed.

3. The method of claim 2 with the additional step of rotating a material conditioning roller in pressure indented relation with the surface of the single inking form roller to form a matte finish on the surface of the fresh ink before applying dampening fluid to increase the adhesion of dampening fluid to the fresh film of ink.

4. The method of claim 3 wherein the dampening fluid is metered between a resilient surfaced roller and a hard hydrophilic surfaced roller; and with the addition of the step of: rotating the hard hydrophilic surfaced roller at a surface speed which is different from the surface speed of the inking form roller to transfer dampening fluid to ink on the inking form roller; and rotating the inking form roller to apply dampening fluid and ink to the printing plate.

5. The method of any one of claims 2, 3 or 4 wherein the step of applying fresh ink comprises the steps of: positioning a metering member having a metering edge and a trailing edge in pressure indented relation with the resilient surface on said single inking form roller such that ink carried by the resilient roller surface impinges against a substantially flat metering surface on said metering member adjacent to the metering edge; urging both the metering edge and the trailing edge in a direction generally radially of the single inking form roller to urge both the metering edge and the trailing edge into indented relation with the resilient roller surface; resiliently supporting the metering member in a direction radially of the inking form roller to permit movement of the metering edge relative to the axis of the inking form roller; and supporting said metering edge to prevent movement of the metering edge in a direction tangent to the inking form roller.

6. A method of inking a lithographic printing plate comprising the steps of:

providing a source of ink which is substantially free of dampening fluid;

applying a film of ink from the source to the surface of a form roller at an ink metering nip to form a film of ink which is substantially free of dampening fluid;

forming a dampening fluid receptive surface on the metered film of ink;

applying dampening fluid at a dampening nip to the dampening fluid receptive surface on the film of ink;

rotating the form roller to transfer ink and dampening fluid at an inking nip to the printing plate;

urging a doctor blade into pressure indented relation with the form roller surface;

establishing an angular relationship between the doctor blade and the surface of the form roller to remove dampening fluid from ink remaining on the form roller after the form roller has transferred ink and dampening fluid to the printing plate at the inking nip and before the ink metering nip;

directing a high velocity air stream to impinge against the ink to evaporate dampening fluid not removed by the doctor blade; and forming a matte surface on the ink subsequent to impingement of the air stream thereagainst.

7. An inker for a lithographic printing press wherein a dampener applies dampening fluid to a lithographic printing plate to render hydrophilic non-image areas on the printing plate ink rejecting, and wherein an inker applies ink having a viscosity significantly greater than the viscosity of the dampening fluid to the lithographic printing plate, the improvement comprising: a resilient inking form roller; a doctor blade having a metering surface; means positioning the doctor blade into pressure indented relation with the inking form roller with the metering surface of the doctor blade at an angle relative to a line tangent to the roller to efficiently remove dampening fluid having a viscosity less than a predetermined viscosity from the roller surface and leaving ink on the form roller surface having a viscosity greater than the predetermined viscosity; means directing a stream of drying fluid to evaporate dampening fluid from the surface of the inking form roller; and means to apply a film of fresh ink on the inking form roller.

8. An inker for a lithographic printing press comprising a roller having a resilient outer surface and means operative, upon rotation of the roller, for forming, from a liquid film of ink of irregular thickness carried by the roller, a thin liquid film of ink of uniform thickness, said means comprising a metering member pressed substantially radially inwards of the roller, said metering member having a metering edge and a trailing edge and presenting to the irregular liquid film, a substantially flat metering surface on the metering member adjacent the metering edge; means urging both the metering edge and the trailing edge into indented relation with the resilient roller surface; means applying dampening fluid to a film of ink formed by the metering member; and evaporator means having an elongated slot to direct a continuous high velocity stream of air across the length of the roller in a direction substantially tangentially of the roller and opposite to the direction of movement of the roller surface to evaporate dampening fluid from an irregular film of ink and dampening fluid remaining on the form roller after inking the printing plate.

9. An inker as defined in claim 8 wherein said evaporator means comprises a plurality of evaporation devices spaced around the periphery of said inking form roller.

10. An inker as defined in claim 9 wherein said evaporation devices each provide nozzle means expelling a continuous stream of air to impinge on said form roller across substantially the full width thereof.

11. An inker as defined in claim 8 wherein said evaporator means comprises a conduit means having a slit opening along a substantial portion of its length.

12. An inker as defined in claim 8 wherein said evaporator means comprises a housing member having a pair of walls in converging relationship and defining a slot like opening along a substantial length of said housing member.

13. An inker as defined in claim 8 wherein said evaporator means comprises an elongated housing member having an internal baffle directing drying gas toward one wall of said housing and an edge surface of said one wall being positioned in close proximity to the surface of said form roller over substantially the full width of said form roller.

* * * * *

UNITED STATES PATENT AND TRADEMARK OFFICE

CERTIFICATE OF CORRECTION

PATENT NO. : 4,452,139

DATED : June 5, 1984

INVENTOR(S) : Harold P. Dahlgren, James E. Taylor, Dwight W. Peters

It is certified that error appears in the above-identified patent and that said Letters Patent are hereby corrected as shown below:

Col. 1, line 18, change "a", first occurrence, to -- an --

Col. 1, line 18, delete "base"

Col. 4, line 32, change "illustraed" to -- illustrated --

Col. 8, line 63, change "from" to -- form --

Signed and Sealed this

*Eleventh* Day of *December 1984*

[SEAL]

*Attest:*

GERALD J. MOSSINGHOFF

*Attesting Officer* *Commissioner of Patents and Trademarks*